US005143567A

United States Patent [19]

Taylor et al.

[11] Patent Number: 5,143,567

[45] Date of Patent: Sep. 1, 1992

[54] ADDITIVE APPROACH TO BALLISTIC AND SLAG MELTING POINT CONTROL OF AZIDE-BASED GAS GENERANT COMPOSITIONS

[75] Inventors: Robert D. Taylor, Hyrum; Lewis R. Huntsman, Willard, both of Utah

[73] Assignee: Morton International, Inc., Chicago, Ill.

[21] Appl. No.: 749,032

[22] Filed: Aug. 23, 1991

[51] Int. Cl.[5] ..... C06B 35/00

[52] U.S. Cl. ..... 149/35; 149/61

[58] Field of Search ..... 149/35, 61

[56] References Cited

U.S. PATENT DOCUMENTS

| | | | |
|---|---|---|---|
| 2,981,616 | 4/1961 | Boyer | 149/35 |
| 3,883,373 | 5/1975 | Sidebottom | 149/35 |
| 3,904,221 | 9/1975 | Shiki et al. | 280/150 AB |
| 3,947,300 | 3/1976 | Passauver et al. | 149/35 |
| 4,094,028 | 6/1978 | Fujayama et al. | 149/35 |
| 4,203,787 | 5/1980 | Kirchoff et al. | 149/35 |
| 4,296,084 | 10/1981 | Adams et al. | 423/351 |
| 4,376,002 | 3/1983 | Utracki | 149/35 |
| 4,533,416 | 8/1985 | Poole | 149/35 |
| 4,547,235 | 10/1985 | Schneiter et al. | 149/35 |
| 4,604,151 | 8/1986 | Knowlton et al. | 149/35 |
| 4,696,705 | 9/1987 | Hamilton | 149/35 |
| 4,698,107 | 10/1987 | Goetz et al. | 149/35 |
| 4,806,180 | 2/1989 | Goetz et al. | 149/35 |
| 4,834,818 | 5/1989 | Kazumi et al. | 149/35 |
| 4,836,255 | 6/1989 | Schneiter et al. | 149/35 |
| 4,981,536 | 1/1991 | Bender | 149/35 |

*Primary Examiner*—Stephen J. Lechert, Jr.
*Attorney, Agent, or Firm*—L. Dewayne Rutledge; Gerald K. White

[57] ABSTRACT

Gas generant pyrotechnic compositions especially suitable for inflating vehicle occupant restraint systems with nitrogen gas are described. The compositions are comprised (in wt. %) of about 65-74% of an azide, preferably sodium azide; about 17-25% of iron oxide, preferably ferric oxide; and about 3.5-6% metal nitrite or nitrate co-oxidizer, preferably sodium nitrate; to which base composition is added about 2.5-8% silica, alumina, titania or mixtures thereof, up to 6% bentonite and up to 4% molybdenum disulfide. Preferred driver and passenger side formulations are disclosed.

The compositions burn from about 1.0 to 1.5 inches per second, have excellent slag and clinker properties, as well as excellent aging and mechanical strength characteristics when formed into cylindrical pellets or wafers.

The formulation ingredients are amenable to water slurry mixing, spray drying and machine pressing into cylindrical pellets or wafers for insertion into a suitable gas generating device.

17 Claims, 1 Drawing Sheet

ADDITIVE APPROACH TO BALLISTIC AND SLAG MELTING POINT CONTROL OF AZIDE-BASED GAS GENERANT COMPOSITIONS

BACKGROUND OF THE INVENTION

1. Field of the Invention

The present invention relates to gas generant or propellant compositions which when formed into cylindrical pellets, wafers or other appropriate physical shapes may be combusted in a suitable gas generating device to generate cool nitrogen gas and easily filterable condensed phase products. The resultant gas is then preferably used to inflate an air bag which serves as an automobile occupant cushion during a collision. More particularly this invention relates to azide-based gas generant compositions including special additives, and additive amounts, to control the linear burning rate of any such shapes produced therefrom and to control the viscosity or melting point of the slag or clinker produced.

Even though the gas generant compositions of this invention are especially designed and suited for creating nitrogen for inflating passive restraint vehicle crash bags, it is to be understood that such compositions would function equally well in other less severe inflation applications, e.g. aircraft slides, inflatable boats, and inflatable lifesaving buoy devices as in U.S. Pat. No. 4,094,028, and would in a more general sense find utility any place where a low temperature, non-toxic source of nitrogen gas is needed.

2. Description of the Prior Art

Automobile air bag systems have been developed to protect the occupant of a vehicle, in the event of a collision, by rapidly inflating a cushion or bag between the vehicle occupant and the interior of the vehicle. The inflated air bag absorbs the occupant's energy to provide a gradual, controlled ride down, and provides a cushion to distribute body loads and keep the occupant from impacting the hard surfaces of the vehicle interior.

The use of protective gas-inflated bags to cushion vehicle occupants in crash situations is now widely known and well documented. In early systems of this type, a quantity of compressed, stored gas was employed to inflate a crash bag which, when inflated, was positioned between the occupant and the windshield, steering wheel and dashboard of the vehicle. The compressed gas was released by the action of actuators or sensors which sensed a rapid change in velocity of the vehicle during a rapid impact, as would normally occur during an accident. Because of the bulk and weight of such stored, compressed gas systems, their generally slow reaction time and attendant maintenance difficulties, these type systems are now largely obsolete, having been superseded by air bag systems utilizing a gas generated by chemical gas-generating compositions. These advanced systems involve the use of an ignitable propellant composition for inflating the air cushion, wherein the inflating gas in generated by the exothermic reaction of the reactants which form the propellant.

The most common air bag systems presently in use include an on-board collision sensor, an inflator, and a collapsed, inflatable bag connected to the gas outlet of the inflator. The inflator typically has a metal housing which contains an electrically initiated igniter, a gas generant composition, for example, in pellet or tablet form, and a gas filtering system. Before it is deployed, the collapsed bag is stored behind a protective cover in the steering wheel (for a driver protection system) or in the instrument panel (for a passenger system) of the vehicle. When the sensor determines that the vehicle is involved in a collision, it sends an electrical signal to the igniter, which ignites the gas generant composition. Then the gas generant composition burns, generating a large volume of relatively cool gaseous combustion products in a very short time. The combustion products are contained and directed through the filtering system and into the bag by the inflator housing. The filtering system retains all solid and liquid combustion products within the inflator and cools the generated gas to a temperature tolerable to the vehicle passenger. The bag breaks out of its protective cover and inflates when filled with the filtered combustion products emerging from the gas outlet of the inflator. See, for example, U.S. Pat. Nos. 3,904,221 and 4,296,084.

The requirements of a gas generant suitable for use in an automobile airbag device are very demanding. The gas generant must have a burning rate such that the air bags are inflated rapidly (within approximately 30 milliseconds). The burning rate must not vary with aging or as a result of shock and vibration during normal deployment. The burning rate must also be relatively insensitive to changes in moisture content and temperature. When pressed into pellets or other solid form, the hardness and mechanical strength of the pellets must be adequate to withstand the mechanical environment to which it may be exposed without any fragmentation or change of exposed surface area. Any breakage of the pellets would potentially lead to an undesirable high pressure condition within the generator device and possible explosion.

The gas generant must efficiently produce cool, non-toxic, non-corrosive gas which is easily filtered to remove solid or liquid products, and thus preclude damage to the inflatable bag(s) or to the occupant(s) of the automobile.

The requirements as discussed in the preceding paragraphs limit the applicability of many otherwise suitable compositions from being used as air bag gas generants.

Mixtures of sodium azide and iron oxide are favored because a low reaction temperature (approximately 1000 degrees centigrade) is produced, the reaction products are solids or liquids which are easily filtered within a gas generator device, and the mixtures produce a high volume of non-toxic gas. Without the use of other oxidizers and additives, however, the burning rates are typically very low. Iron oxide is also a very hard substance which causes machinery to wear with prolonged use, and can impart a hygroscopic nature to the formulations if very fine ferric oxide is used. Some severe aging problems have also been experienced particularly when certain additives have been used in conjunction with sodium azide and ferric oxide. U.S. Pat. No. 4,203,787 discloses that ferric oxide based gas generants with azide fuels have been less preferred than other oxidizers because they burn unstably and slowly, and are difficult to compact into tablets.

The problems associated with the low burning rate of sodium azide and ferric oxide compositions have largely been overcome by the use of co-oxidizers such as an alkali metal nitrate or perchlorate (see, for example, U.S. Pat. Nos. 4,203,787; 4,547,235; 4,696,705; 4,698,107; 4,806,180 and 4,836,255. The inclusion of co-oxidizers has, however, in addition to causing an increase in the burning rate of the compositions, resulted in an increase in the flame temperature, with some consequent loss in the ability to form good solid product clinkers.

The hygroscopic nature of the sodium azide and ferric oxide formulations has been shown to be reduced by the addition of hydrophobic fumed silica (see aforementioned U.S. Pat. No. 4,836,255). The use of the hydrophobic fumed silica reduces the moisture sensitivity of sodium azide and ferric oxide compositions and also interacts with the solid or liquid products to improve clinkering by the formation of alkali metal silicates which have a higher melting point than the alkali metal oxide products. The silicates also likely serve to increase the viscosity of the liquid products making them easier to filter in a gas generator device.

The use of silicate additives for the purpose of improved clinkering and burning rate control in compositions containing sodium azide, ferric oxide, and potassium nitrate is described in aforementioned U.S. Pat. No. 4,547,235. While clinkering is improved, the large amounts of silica used were actually effective in reducing the burning rate of the formulations when the silica levels were increased at the expense of the potassium nitrate.

Aforementioned U.S. Pat. Nos. 4,696,705; 4,698,107 and 4,806,180 describe formulations comprised of sodium azide, ferric oxide, sodium nitrate, silica, bentonite (a mineral), and graphite fibers. These patents disclose the burning rate enhancement qualities of the graphite fibers, but does not expressly state the purpose and function of the bentonite and fumed silica additives. The patents also imply an equivalence of the fumed metal oxides (alumina, silica, and titania). Within these patent disclosures bentonite is not considered to be equivalent to the fumed metal oxides.

Also of interest is the teachings regarding the use of various combustion catalyts and/or slag/residue control and similar agents in azide-based propellants in general found in U.S. Pat Nos. 2,981,616; 3,883,373; 3,947,300; 4,376,002; 4,604,151; 4,834,818 and 4,981,536.

U.S. Pat. No. 4,533,416 is also of general interest in the Example 6 teaching of adding 2% bentonite to a $NaN_3$—$Fe_2O_3$ based propellant, presumably for its binding properties which proved ineffectual.

Throughout this specification all percentages of compositional ingredients are by weight based on total composition weight unless otherwise indicated.

SUMMARY OF THE INVENTION

In accordance with the present invention there is provided an azide-iron oxide-metal nitrate based propellant composition which is made to burn at a controlled linear burn rate of about 1.0 to 1.5 inches per second while providing excellent slag melting point or viscosity control by the addition of optimum amounts of one or more of the metal oxide additives: silica, alumina, titania and bentonite. Preferably a combination of the oxide additives is provided. A small amount of molybdenum disulfide may also be incorporated. The presence of fibrous mechanical additives, such as graphite fibers, is excluded from the propellant mixture or matrix.

The basic propellant composition according to the invention contains from about 65–74% azide fuel, preferably sodium azide; from about 17–25% iron oxide, preferably ferric oxide; from about 3.5–6% metal nitrite or nitrate co-oxidizer, preferably sodium nitrate; and to which basic mixture is added about 2.5–8% silica, alumina, titania or mixture thereof, preferably a combination of silica and alumina,together with up to 6% bentonite and up to 4% molybdenum disulfide. One preferred additive mixture comprises 2.5–5% silica plus alumina most preferably about 0.5% silica plus 2% alumina, together with 3–6%, preferably 3%, bentonite for driver side air bag application. Another preferred additive mixture comprises 5–8% silica plus alumina, most preferably 0.5% silica plus 5% alumina, together with less than 3%, preferably 0%, bentonite for passenger side application. The preferred amount of molybdenum disulfide present in either application is about 1%.

DETAILED DESCRIPTION OF THE INVENTION

The gas generant according to the invention broadly includes the following ingredients:

(1) an azide, which is one or more alkali or alkaline earth metal azides, preferably one or more alkali metal azides, most preferably sodium azide, (2) iron oxide, which is one or more of the three iron oxides (FeO, $Fe_2O_3$ and $Fe_3O_4$), preferably ferric oxide, (3) a metal nitrite or nitrate, which is one or more alkali metal nitrites or nitrates, preferably sodium nitrate, (4) special additives selected from the group consisting of silica, alumina, titania, bentonite and mixtures thereof, and (5) may include molybdenum disulfide.

The azide is the gas generant fuel which liberates nitrogen gas when oxidized by the oxidizers. The iron oxide functions as an oxidizer. The iron oxide may be replaced in whole or in part by one or more of the oxides of chromium, manganese, cobalt, copper and vanadium. The metal nitrite or nitrate is a co-oxidizer which provides additional heat to the azide and iron oxide formulation which in turn increases the linear burning rate of the composition and also provides good low temperature ignition characteristics. The silica additive provides increased linear burning rate control and, to a limited degree, higher slag melting point or viscosity control, forming silicates as products. The alumina additive primarily provides for increased slag melting point or viscosity control and secondarily provides for increased linear burning rate control by the formation of aluminates as products. The titania provides for higher linear burning rate control, forming titanates as products, but does not increase the melting point or viscosity of the slag. The silica, alumina and titania as used herein may or may not be fumed. The bentonite additive is a montmorillonite mineral which is hydrous aluminum silicate of the approximate formula: $(Al, Fe_{1.67}, Mg_{0.33})\ Si_4O_{10}(OH)_2\ (Na,Ca_{0.33})$. Bentonite provides for increased burning rate control, particularly when used at low levels, presumably by the formation of silicates and aluminates as products. The molybdenum disulfide functions as a binder and pressing aid for machine pressing (molding) operations, and also has a limited effect on the composition burning rate, presumably by making it opaque.

Figure 1:
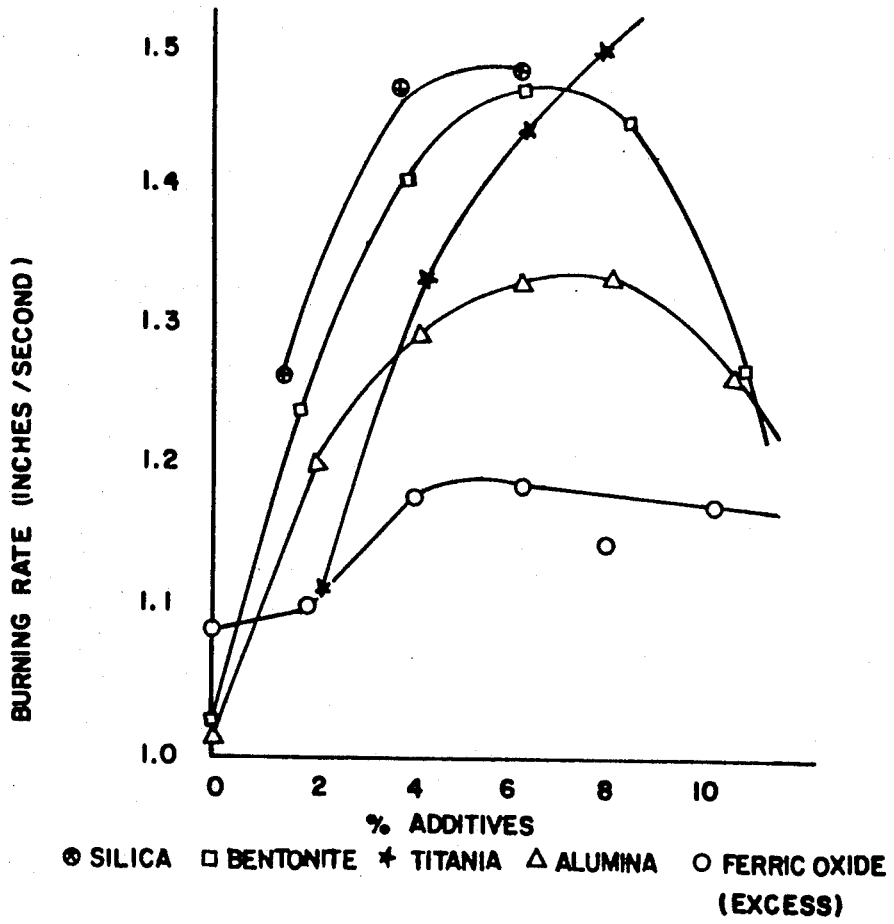
FIG. 1 illustrates in graph form the effect on the burning rate of a stoichiometric propellant formulation of sodium azide, ferric oxide and sodium nitrate (5%) of various additive metal oxides.

When considered as a group the metal oxides (silica, bentonite, titania, alumina as well as excess iron oxide) all produce increased burning rates relative to a stochiometric formulation comprised of sodium azide, ferric oxide and sodium nitrate as, for example, shown in FIG. 1. Burning rate enhancement is shown to be greatest with silica, bentonite and titania, and least for the excess ferric oxide. The effect of alumina is intermediate between the two above groups. The burning rate enhancement is a maximum when the level of the metal oxides is approximately 6% by weight. FIG. 1 illustrates that the burn rate of the compositions are tailorable within the range of approximately 1.0–1.5 inches per second. Intermediate burning rates are also obtained with additive mixtures. For example, using a composition including bentonite at a levels of 3% and alumina at 2% produces a burning rate intermediate between either ingredient at the 5% level. The formulations of FIG. 1 all contain sodium nitrate at the 5% level.

Figure 2:
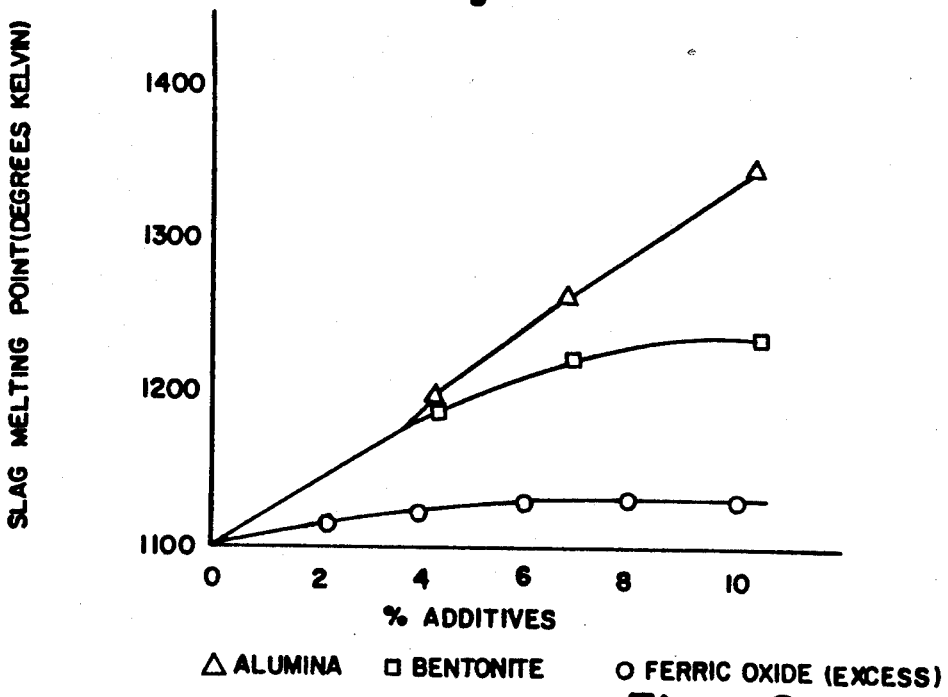
FIG. 2 illustrates in graph form the effect on the slag melting point of the same stoichiometric formulation shown in FIG. 1 of various additive metal oxides.

The effect of the metal oxide levels on the slag melting point is shown in FIG. 2 for bentonite, alumina, and ferric oxide. (These are the same basic $NaN_3$—$Fe_2O_3$—$NaNO_3$ formulations for which the burning rate effects are shown in FIG. 1). Examination of FIG. 2 reveals that alumina is more effective than than either bentonite or iron oxide (excess) in the promotion of high slag melting points. The melting points of comparable formulations containing silica show it to have about the same effect as bentonite.

The preceding examples serve to illustrate that the metal oxides ($SiO_2$, $Al_2O_3$, $TiO_2$, and bentonite) are not fully equivalent in their effects on both the burning rate and slag melting points of a gas generant composition comprised of sodium azide, ferric oxide, and sodium nitrate. The technology of using combinations of the metal oxides (silica, bentonite, alumina, and titania) in sodium azide, ferric oxide and sodium nitrate gas generant compositions is especially shown to meet the balanced formulation objectives of producing high burning rate and high slag melting point (which allows excellent clinkering and easy particulate filtering by the gas generator device).

In general the nitrogen gas generant composition according to the invention consists essentially of the above named ingredients in the amounts shown as follows:

TABLE 1

| INGREDIENT | AMOUNT (%) |
|---|---|
| azide fuel | about 65–74 |
| iron oxide | about 17–25 |
| nitrite/nitrate co-oxidizer | about 3.5–6.0 |
| metal oxide (silica, alumina, titania or mixtures) | about 2.5–8.0 |
| bentonite | up to about 6.0 |
| molybdenum disulfide | up to about 4.0 |

A preferred general composition of the gas generant under the above genus consists essentially as follows:

TABLE 2

| INGREDIENT | AMOUNT (%) |
|---|---|
| sodium azide | 65–74 |
| ferric oxide | 17–25 |
| sodium nitrate | 3.5–6.0 |
| metal oxide (silica, alumina, titania or mixtures) | 2.5–8.0 |
| bentonite | 0–6.0 |

TABLE 2-continued

| INGREDIENT | AMOUNT (%) |
|---|---|
| molybdenum disulfide | 0–4.0 |

Preferred sub-generic compositions under the Table 2 genus have been developed depending on whether used for driver side or passenger side air bag applications. A composition with a slightly higher burning rate, preferred for the driver side, is generally represented as follows:

TABLE 3

| INGREDIENT | AMOUNT (%) |
|---|---|
| sodium azide | 65–74 |
| ferric oxide | 17–25 |
| sodium nitrate | 3.5–6.0 |
| metal oxide (silica, alumina, titania or mixtures) | 2.5–5.0 |
| bentonite | 3.0–6.0 |
| molybdenum disulfide | 0–4.0 |

A specific composition under the Table 3 genus preferred for the driver side is as follows:

TABLE 4

| INGREDIENT | AMOUNT (%) |
|---|---|
| sodium azide | 67.96 |
| ferric oxide | 20.54 |
| sodium nitrate | 5.0 |
| silica | 0.5 |
| alumina | 2.0 |
| bentonite | 3.0 |
| molybdenum disulfide | 1.0 |

A composition with a slightly lower burning rate and even better slag producing qualities, preferred for the passenger side, is generally represented as follows:

TABLE 5

| INGREDIENT | AMOUNT |
|---|---|
| sodium azide | 65–74 |
| ferric oxide | 17–25 |
| sodium nitrate | 3.5–6.0 |
| metal oxide (silica, alumina, titania or mixtures) | 5.0–8.0 |
| bentonite | 0–3.0 |
| molybdenum disulfide | 0–4.0 |

A specific composition under the Table 5 genus preferred for the passenger side is a follows:

TABLE 6

| INGREDIENT | AMOUNT (%) |
|---|---|
| sodium azide | 66.65 |
| ferric oxide | 23.35 |
| sodium nitrate | 3.5 |
| silica | 0.5 |
| alumina | 5.0 |
| molybdenum disulfide | 1.0 |

As can be seen from the above disclosure the compositions of the invention have been tailored for the express purpose of maximizing the burning rate and the viscosity or melting point of the solid combustion products to provide a rapidly functioning device with easily filterable products. In contrast to the formulations making up the grain in aforementioned U.S. Pat. Nos. 4,696,705; 4,698,107 and 4,806,180, the use of graphite fibers would not only be undesirable, but deleterious in the compositions of this invention because the inclusion of such fibers within the formulation would not increase the burning rate and would not increase the mechanical strength of the consolidated material (i.e. when pressed into cylindrical pellets, wafers or other physical forms). Moreover, such a mixture would not be amenable to a wide variety of manufacturing methods such as spray drying to form prills or pellets of the materials suitable for machine pressing into wafers or grains, and would further reduce the gas yield of the composition.

The compositions of the present invention have been designed to provide high performance (high burning rate and high gas output) relative to those of the above patents, and these performance gains relative to the compositions of the patents are achieved by avoiding the use of such graphite fibers and the inclusion of higher levels of metal oxide additives. In accordance with the present invention it has been shown that the metal oxides (silica and titania) and bentonite promote high burning rate while alumina is most effective in producing combustion products of a higher melting point producing easily filterable products.

In the compositions of this invention the addition of graphite fibers is not effective in enhancing the burning rate because the thermal conductivity of the fibers is slow compared to the burning rate and hence in-depth heating of the propellant grains is not achieved to any substantial degree. The mechanical effect of the fibers to increase the burning rate is also diminished by the fact that the fiber orientation cannot be controlled and therefore higher levels of the randomly distributed fibers are required to achieve the same burning rate as could be achieved with total fiber orientation parallel to the direction of burn. The addition of the graphite fibers represents the addition of an inert ingredient which must be used in large quantities to achieve the same overall effects of reduced quantities of metal oxide ingredients. The increased burning rate and gas output of the compositions of this invention allow simple grain configurations to be used within the gas generator, such as cylindrical pellets or wafers rather than complex multiperforated grains, and allows the use of smaller quantities of compositions within the inflator devices due to the increased gas output of the compositions.

Similarly other known fibrous mechanical additives , such as glass fibers, and especially those which have a fairly large thermal conductivity, such as iron, copper and nickel fibers, are equally undesirable and deleterious in regard to the subject invention and are avoided.

With this description of the invention in detail, those skilled in the art will appreciate that various modifications may be made to the invention without departing from the spirit thereof. Therefore it is not intended that the scope of the invention be limited to the specific embodiments illustrated and described. Rather it is intended that the invention scope be determined by the appended claims and their equivalents.

We claim:

1. A composition for generating nitrogen gas consisting essentially of (all percents by weight):

A. between about 65 and 74 percent of azide fuel,

B. between about 17 and 25 percent iron oxide oxidizer,

C. between about 3.5 and 6.0 percent of a co-oxidizer selected from the group consisting of metal nitrites, nitrates and mixtures thereof, D. between about 2.5 and 8.0 percent of a metal oxide additive selected from the group consisting of silica, alumina, titania and mixtures thereof, E. up to about 6.0 percent bentonite, and F. up to about 4.0 percent molybdenum disulfide, said composition having a controllable burning rate between about 1.0 and 1.5 inches per second.

2. A composition according to claim 1 wherein said fuel is at least one alkali or alkaline earth metal azide.

3. A composition according to claim 2 wherein said fuel is at least one alkali metal azide.

4. A composition according to claim 3 wherein said fuel is sodium azide.

5. A composition according to claim 1 wherein said iron oxide is ferric oxide.

6. A composition according to claim 1 wherein co-oxidizer is at least one alkali metal nitrate.

7. A composition according to claim 6 wherein said co-oxidizer is sodium nitrate.

8. A composition according to claim 1 wherein said additive consists of a mixture of silica and alumina.

9. A composition according to claim 8 wherein between about 2.5 and 5.0 percent of said additive is present.

10. A composition according to claim 9 wherein between about 3.0 and 6.0 percent bentonite is present.,

11. A composition according to claim 8 wherein between about 5.0 and 8.0 percent of said additive is present.

12. A composition according to claim 11 wherein less than about 3.0 percent bentonite is present.

13. A composition according to claim 10 wherein about 1 percent molybdenum disulfide is present.

14. A composition according to claim 12 wherein about 1 percent molybdenum disulfide is present.

15. A composition for generating nitrogen gas consisting of (all percents by weight):

A. about 67.96 percent sodium azide,

B. about 20.54 percent ferric oxide,

C. about 5.0 percent sodium nitrate,

D. about 0.5 percent silica,

E. about 2.0 percent alumina,

F. about 3.0 percent bentonite, and

G. about 1.0 percent molybdenum disulfide.

16. A composition for generating nitrogen gas consisting of (all percents by weight):

A. about 66.65 percent sodium azide,

B. about 23.35 percent ferric oxide,

C. about 3.5 percent sodium nitrate,

D. about 0.5 percent silica,

E. about 5.0 percent alumina, and

F. about 1.0 percent molybdenum disulfide.

17. A composition for generating nitrogen gas consisting essentially of (all percents by weight):

A. between about 65 and 74 percent of azide fuel,

B. between about 17 and 25 percent of an oxidizer selected from the group consisting of iron oxide, chromium oxide, manganese oxide, cobalt oxide, copper oxide, vanadium oxide and mixtures thereof, C. between about 3.5 and 6.0 percent of a co-oxidizer selected from the group consisting of metal nitrites, nitrates and mixtures thereof, D. between about 2.5 and 8.0 percent of a metal oxide additive selected from the group consisting of silica, alumina, titania and mixtures thereof, E. up to about 6.0 percent bentonite and F. up to about 4.0 percent molybdenum disulfide, said compositions having a controllable burning rate between about 1.0 and 1.5 inches per second.

* * * * *